United States Patent [19]

Larkin

[11] 4,400,006

[45] Aug. 23, 1983

[54] GOLF BAG PROVIDED WITH A RETRACTABLE ROLLING ASSEMBLY

[76] Inventor: Sam Larkin, 254 Beach 140th St., Belle Harbor, N.Y. 11694

[21] Appl. No.: 303,903

[22] Filed: Sep. 21, 1981

Related U.S. Application Data

[63] Continuation-in-part of Ser. No. 214,129, Dec. 8, 1980, Pat. No. 4,382,612.

[51] Int. Cl.[3] ..... B62B 3/02

[52] U.S. Cl. ..... 280/646; 280/6 R

[58] Field of Search ..... 280/646, 652, 47.37 R, 280/40, DIG. 3, 5, 6; 301/120, 121, 122; 403/341, 154, 155, 318, 349; 411/337, 169; 16/110 R, 114 R, DIG. 2, 24

[56] References Cited

U.S. PATENT DOCUMENTS

| | | | |
|---|---|---|---|
| 1,140,036 | 5/1915 | Hella | 411/337 |
| 3,014,732 | 12/1961 | Schemenauer | 280/646 |
| 3,150,881 | 9/1964 | Van Skyock | 280/646 |
| 3,831,958 | 8/1974 | Keaton | 280/646 |
| 3,985,373 | 10/1976 | Widegren | 280/652 |
| 4,074,741 | 2/1978 | Moore et al. | 403/341 X |

FOREIGN PATENT DOCUMENTS

| | | | |
|---|---|---|---|
| 972248 | 1/1951 | France | 403/349 |
| 1371442 | 7/1964 | France | 301/121 |
| 88344 | 9/1956 | Norway | 280/DIG. 3 |
| 16504 | of 1912 | United Kingdom | 403/349 |

*Primary Examiner*—Robert J. Spar
*Assistant Examiner*—Donald W. Underwood
*Attorney, Agent, or Firm*—Goodman & Teitelbaum

[57] ABSTRACT

A golf bag having an elongated container with a retractable rolling assembly coupled to the container. The rolling assembly can be moved between an extended position and a retracted folded position. A locking device securely retains the entire rolling assembly in its folded position. A locking arrangement locks the entire rolling assembly in its extended position. A detachable wheel is connected at each end of the shaft of the rolling assembly by a floating ring positioned about a reduced diameter portion of the shaft. The ring is normally maintained by gravity in an interference position wherein it extends beneath the periphery of the shaft to prevent removal of the wheel. The ring can be manually aligned with the shaft to permit the wheel to be mounted on and removed from the shaft.

19 Claims, 16 Drawing Figures

GOLF BAG PROVIDED WITH A RETRACTABLE ROLLING ASSEMBLY

RELATIONSHIP TO OTHER APPLICATIONS

This application is a continuation-in-part application of Ser. No. 214,129 filed Dec. 8, 1980, U.S. Pat. No. 4,382,612 for a "Rollable Golf Bag," the entire disclosure of which is herein incorporated by reference.

BACKGROUND OF THE INVENTION

This invention relates to a golf bag, and more particularly to a golf bag having a retractable rolling assembly to facilitate rolling about of the golf bag when desired.

Golf bags are normally carried around by means of a hand strap or shoulder strap. However, the weight of the golf bag often provides a difficult burden for the golfer. As a result, a caddy may be hired to carry around the golf bag, or a golf cart may be used to transport the golf bag around the golf course. In either case, additional cost is necessitated in order to avoid the burden of transporting the golf bag around by the golfer himself. Although wheels could be permanently placed on the golf bag, these would be awkward when trying to carry the golf bag rather than rolling it. Also, it would create an awkward shape to the golf bag making it difficult to store.

Accordingly, there is needed a golf bag which can be selectively utilized as a regular golf bag for transporting by hand or over the shoulder, as is generally used. At the same time, the golf bag should be able to be wheeled around the golf course without the need of a separate golf cart.

SUMMARY OF THE INVENTION

It is accordingly an object of the present invention to provide a golf bag which avoids the aforementioned problems of the prior art devices.

Another object of the present invention is to provide a rollable golf bag which includes a retractable rolling assembly which is securely retained in either its folded or extended position.

Still another object of the present invention is to provide a rollable golf bag including a retractable rolling assembly which can be easily moved from its retracted folded position to its extended position, and which can be securely locked in place in its extended position for reliable wheeling about of the golf bag.

Still a further object of the present invention is to provide a rollable golf bag having a retractable rolling assembly which in its extended position is securely retained in place by a single convenient locking mechanism.

Still another object of the present invention is to provide a rollable golf bag having a rolling assembly with detachable wheels and including a simplified locking arrangement for retaining the detachable wheels in place.

Still another object of the present invention is to provide a detachable wheel assembly utilizing a simplified arrangement for facilitating placement and removal of a detachable wheel onto an axle.

Briefly, in accordance with the present invention, there is provided a golf bag having an elongated container. A retractable rolling assembly is connected to the container and is movable between an extended position and a retracted folded position. A locking mechanism is included for securely retaining the rolling assembly in its folded position, and a further locking mechanism is provided for retaining the rolling assembly in its extended position.

In an embodiment of the present invention, the rolling assembly includes a pair of support arms pivotally connected to the container and divergingly extendable to an angular orientation with respect to the container. An axle section is pivotally coupled to the distal end of each support arm through an elbow joint and unfolds to lie in coaxial relationship with each other. A slidable sleeve locks the joining ends of the axle sections together and simultaneously locks the support arms in their extended position.

In this embodiment of the present invention, a shaft laterally extends from each axle section. A reduced diameter section is formed adjacent the distal end of each shaft. A ring device floats on the reduced diameter section and is displaceable from an interference position wherein at least a portion of the ring device extends beyond the periphery of the shaft so as to retain a wheel on the shaft into a clearance position wherein the entire ring device is radially contained within the periphery of the shaft to permit removal of the wheel from the shaft. Preferably, the ring device is normally maintaineed in its interference position by means of gravity, and is manually displaceable into its clearance position.

The present invention is also directed to a detachable wheel assembly including at least one axle having a reduced diameter section formed along the axle. A ring floats on the reduced diameter section and is displaceable between an interference position wherein at least a portion of the ring extends radially beyond the periphery of the axle so as to retain a wheel on the axle, and a clearance position wherein the entire ring is radially contained within the periphery of the axle so as to permit removal of a wheel from the axle.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
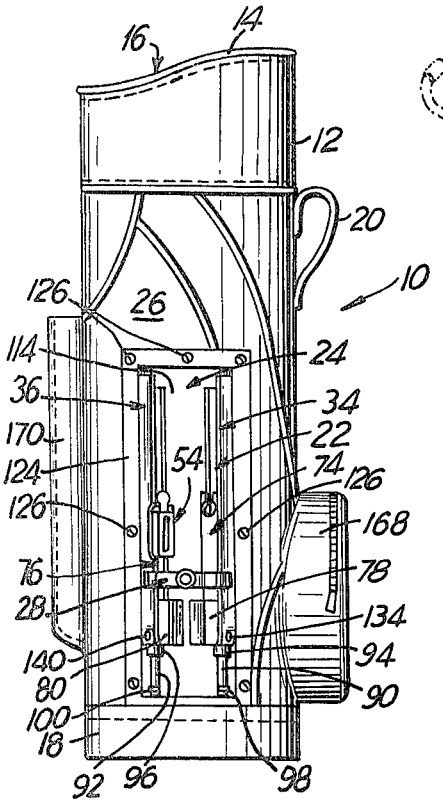
FIG. 1 is an elevational view showing the golf bag of the present invention, and specifically showing the retractable rolling assembly in its retracted folded position.
Figure 2:
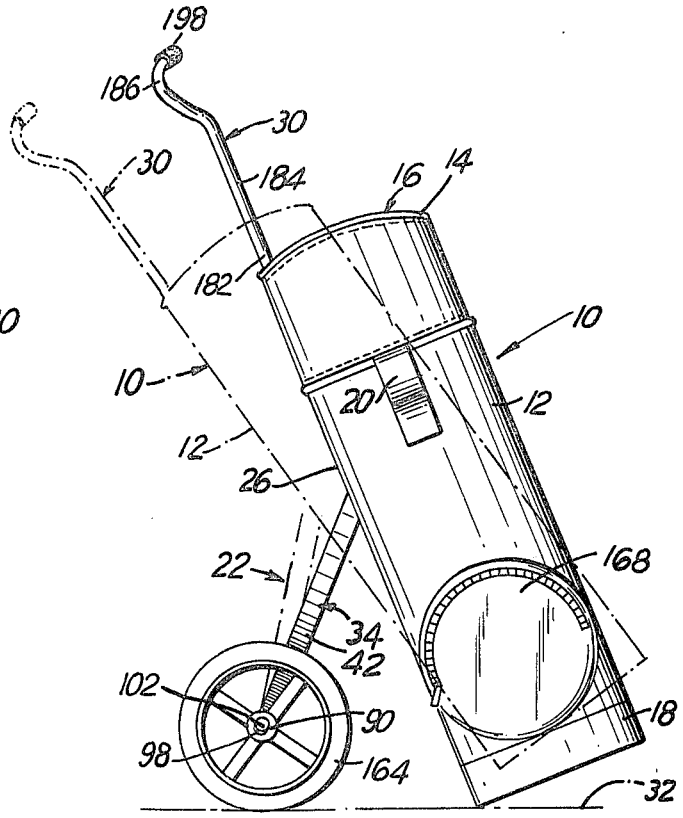
FIG. 2 is a side view showing the golf bag with the rolling assembly in its extended position.

Referring now to FIGS. 1 and 2, the rollable golf bag of the present invention is shown generally at 10 and includes a golf bag container 12 of generally cylindrical elongated shape, substantially as a conventional golf bag. An upper peripheral rim 14 surrounds an open mouth 16, while a lower stiffening member 18 defines a rigid base on which the golf bag can stand. A conventional hand strap 20 is provided to facilitate carrying of the golf bag, wherein the conventional shoulder strap is not shown since the shoulder strap is typically releasably attached to the golf bag by conventional means.

Under normal circumstances, the golf bag would be transported by hand or on the shoulder, using the various straps provided. When it is desired, the golf bag is then placed on the ground and retained in an upright position so that the golf clubs can be extracted through the open mouth 16 of the container 12.

In order to facilitate transporting of the golf bag without the need of a separate golf cart, there is provided a retractable rolling assembly, shown generally at 22, which is mounted within a recessed well 24 formed into a portion of the peripheral wall 26 of the golf bag container 12. The retractable roller assembly 22 can be retained in a retracted folded position, as shown in FIG. 1. In this folded position, the wheels are removed and stored within the golf bag container, as will hereinafter be explained. The various support parts of the rolling assembly are folded so as to be retained within the recessed well 24. The rolling assembly 22 is retained locked in its folded position by means of the spring clip 28, as will hereinafter be explained.

With the rolling assembly in its folded position, the bag can be carried about in its standard manner. When it is desired to roll the golf bag about, the retractable rolling assembly 22 can be released from its folded position by twisting of the spring clip 28, and unfolded to its extended position, as shown in FIG. 2. The wheels are then attached and the golf bag can be tilted and pivoted about the wheels and thereby wheeled about the golf course. A handle 30 can be inserted into the mouth 16 of the golf bag 12 and held in place by means hereinafter described, to facilitate rolling about of the golf bag.

As can be noted from FIg. 2, even when the rolling assembly is in its extended position, the golf bag can still be placed in an upright standing position by pivotally moving the golf bag about the wheel so that the base portion 18 rests against a support surface 32. The golf bag can remain in this supported position to facilitate removal of selected golf clubs. When desired to be rolled, the golf bag is tilted and pivoted about the wheels into a rollable position as shown in the phantom lines, and can then be rolled about.

Figure 3:
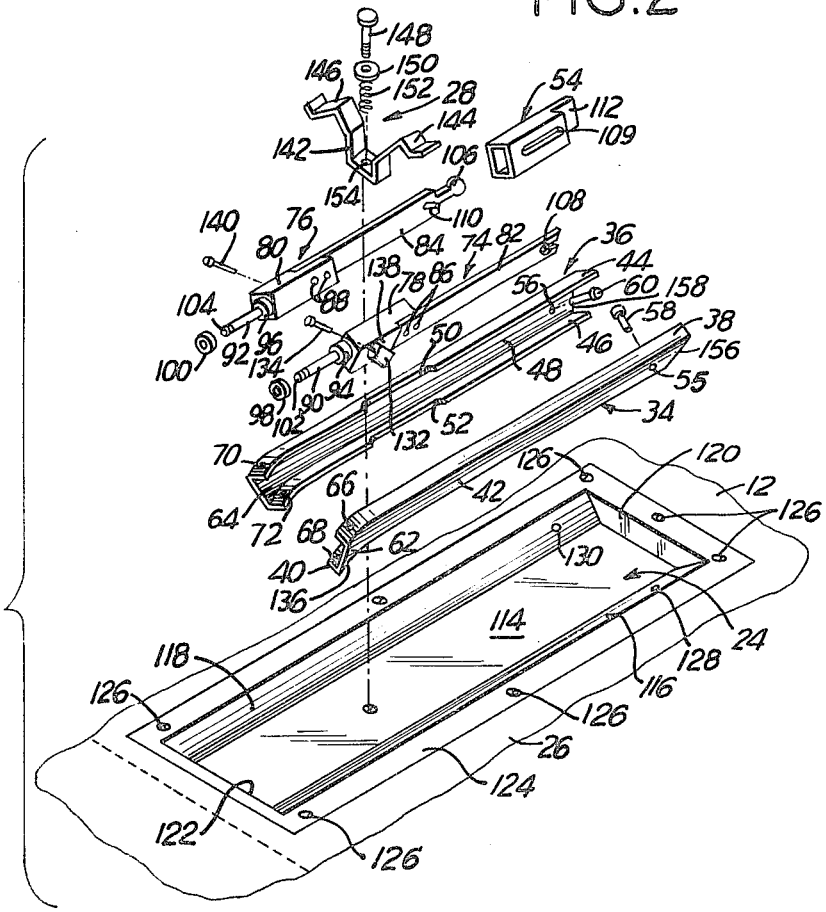
FIG. 3 is an exploded perspective view of the retractable rolling assembly, in accordance with the present invention.

The retractable rolling assembly can best be described in connection with FIG. 3, and includes elongated support arms 34, 36 which are formed of substantially U-shaped channels. The support arm 34 includes the side walls 38 and 40 interconnected by the web 42. The support arm 36 includes the side walls 44 and 46 interconnected by the web 48. It is noted that the walls 44, 46 of the support arm 36 include the opposing notched sections 50, 52 for receiving the locking slide 54, which will be hereinafter explained. The upper, medial ends of the support arms 34, 36 include respective holes 55, 56 which receive respective rivets 58, 60 which serve as pivots. The lower, distal ends of the support arms 34, 36, are downwardly bent at 62, 64, and each distal bent end includes an aligned pair of apertures 66, 68 in the end 62, and 70, 72 in the end 64.

Axle sections 74, 76 each includes a respective connector block 78, 80 with a stepped portion on the outer surface thereof, so as to receive a respective extension bar 82, 84. The connector bars are held onto the respective connector blocks 78, 80 by means of the respective rivets 86, 88.

Laterally extending from each connector block 78, 80 is a respective shaft 90, 92 on which is placed a detachable wheel, as will hereinafter be explained. Collars 94, 96 space the wheel from the connector blocks 78, 80, and floating annular rings or sleeves 98, 100 fit in reduced diameter portions adjacent the distal ends 102, 104 off the shafts 90, 92 to retain the wheels in place, as will hereinafter be explained.

At the medial ends of the connector bars 82, 84 are formed a mating key and keyway including the key portion 106 at the end of the connector bar 84, and the mating keyway 108 at the end of the connector bar 82. Sleeve 54 is shown substantially rectangular in cross section and is shaped to slide along the connector bars 82, 84. A slot 109 is formed on one wall of the locking sleeve 54 to receive the pin 110 extending from the surface of connector bar 84. Pin 110 rides within the slots 109 and permits sliding of the sleeve 54 between the length provided by the slot 109. A tab 112 extends from the rear wall of the sleeve 54 for assisting in the aligning of the connector bars 82, 84 in order to facilitate locking the bars together, as will hereinafter be explained.

The collapsible rolling assembly fits within the recessed well, shown generally at 24, which includes a recessed base wall 114 with angled side walls 116, 118 interconnected at the opposing ends by the vertical end walls 120, 122 and terminating about its upper end by an outwardly extending peripheral flange 124 about the entire perimeter of the recessed well. The well is secured into the peripheral wall 26 of the golf bag container 12 by means of the screws 126, or other similar fastening devices.

Figure 7:
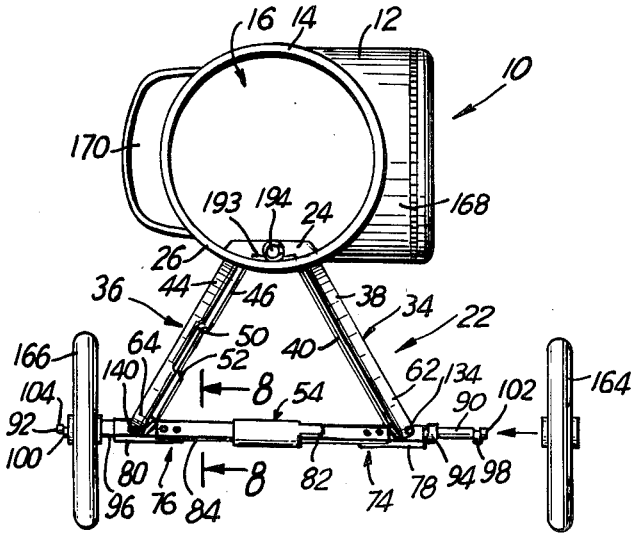
FIG. 7 is a top view of the golf bag showing the rolling assembly in its extended position as shown in FIG. 2, showing the attachment of a wheel.
Figure 8:
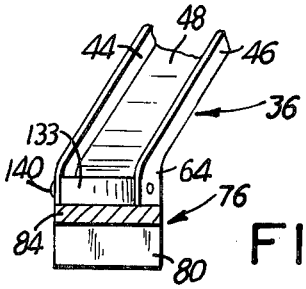
FIG. 8 is a cross sectional view taken along line 8—8 of FIG. 7.
Figure 9:
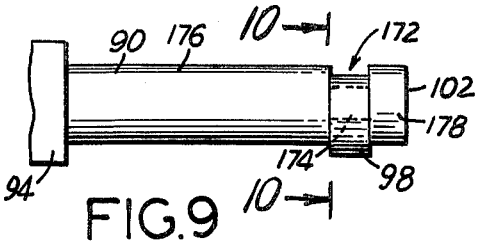
FIG. 9 is a fragmentary enlarged view of the shaft supporting the detachable wheel, specifically showing the floating ring for locking the wheel in place.

The support arms 34, 36 are pivotally mounted to the angled side walls 116, 118 of the recessed well 24 by insertion of the rivets 58, 60 into the openings 128, 130 formed in the angled side walls 16, 118. The axle sections 74, 76 are in turn pivotally mounted into the distal ends of the support arms 34, 36 by means of bushings 132, 133 placed on the connector blocks 78, 80. Bushing 132 is on the outside surface of the connector block 78 as shown in FIG. 3, and bushing 133 is on the outside surface of the connector block 80 as shown in FIG. 8. The bushing 132 is angularly placed along the exterior surface 138 of the connector block 78 and protrudes therefrom so as to be received within the side walls 38, 40 of the U-shaped channel forming the support arm 34. A pivot pin 134 is inserted through the aligned openings 66, 68 in the support arm 34, and through the opening in the bushing 132 contained therebetween, to pivotally connect the axial section 74 to the support arm 34. The arrangement forms an elbow joint whereby the axle section 74 can be folded adjacent and parallel to the support arm 34, as shown in FIG. 1. At the same time, the elbow joint arrangement permits unfolding of the axle section 74 from the support arm 34 in an extended position, as shown in FIG. 7.

In the extended position, the distal edge 136 of the channel forming the support arm 34 abuts against the outer surface 138 of the connector block on which surface is located the bushing 132 and forms a natural stop for the unfolding of the axle section 74 from the support arm 34 in a similar manner as shown in FIG. 8 with respect to the support arm 36 and the axle section 76. In a similar arrangement, the bushing 133 is placed on the outer surface of the connector block 80 and fits between the walls 44, 46 of the channel forming the supporting arm 36. By means of a pivot pin 140 passing through the aligned aperture 70, 72 and through the opening in the bushing 133 located therebetween, the axle section 76 is similarly coupled with an elbow joint arrangement to the support arm 36, as shown best in FIGS. 7 and 8.

Figure 4:
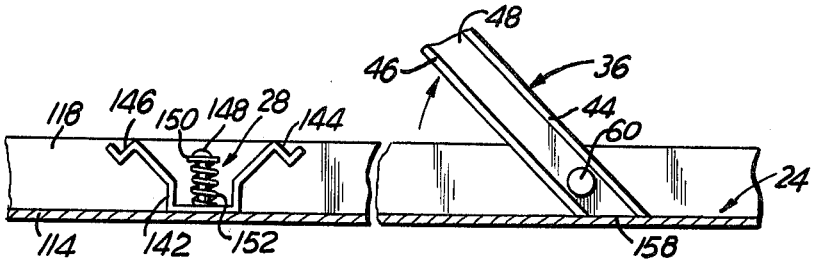
FIG. 4 is a fragmentary sectional view of the recessed well in the golf bag for containing the rolling assembly, showing a support arm in its extended position.

In the folded position, as shown in FIG. 1, the support arms 34, 36 lie adjacent to the angular side walls 116, 118 of the recessed well 24. The axle sections 74, 76 in turn, lie adjacent and parallel to the respective support arms 34, 36. The entire arrangement is securely retained in place by means of the spring clip 28 which includes a substantially U-shaped member 142 provided with outwardly extending legs or wings 144, 146 having an inverted V-shaped with upwardly turned distal ends, as shown in FIGS. 1, 3 and 4. The particular shape provided is one that is congruous with the shape of the parts of the collapsible rolling assembly 22 in its folded position. The spring clip 28 is held in place by means of a screw or rivet 148 passing through a washer 150 and a spring 152. The screw or rivet 148 fits into the aperture 154 provided in the base wall 114 of the recessed well 24.

If desired, a cover (not shown) can be provided to cover the well 24 and the rolling assembly therein when in the folded position, where the cover would preferably be attached to the flange 124 of the well 24 in a conventional manner to permit opening or removal of the cover.

In the folded position, the U-shaped member 142 extends transversely with its side wings 144, 146 laterally positioned so as to fit over the parts of the rolling assembly 22 and hold them securely in place, as shown in FIG. 1. By means of the spring arrangement, the clip 28 can be pulled upwardly against the washer 150 so that it can be rotated out of its transverse holding position and placed in the vertical or longitudinal orientation to lie in the space between the folded parts of the rolling assembly 22, as shown in FIG. 4. The parts of the rolling assembly are then free to be unfolded.

The support arms 34, 36 can then be swung outwardly from the cylindrical golf bag and pivoted about their respective pivots 58, 60 until they are angularly positioned with respect to the golf bag, as shown in FIGS. 2, 4 and 7. The upper edges 156, 158 of the channels are angled, as shown in FIG. 4, to provide a natural stop to the angular movement of the support arms. The support arms move outwardly to make an angle of approximately 45° with respect to the peripheral wall of the golf bag, as shown in FIG. 2.

It should be appreciated, that because the side walls 116, 118 of the recessed well 24 are angled, and since the support arms 34, 36, lie parallel along those angled walls, as the support arms are pivoted outwardly from the peripheral wall of the golf bag, their distal ends diverge with respect to each other, as can best be seen in FIG. 7. With the support arms extended, the axle sections 74, 76 can then be unfolded so as to lie coaxially with respect to each other.

Figure 5:
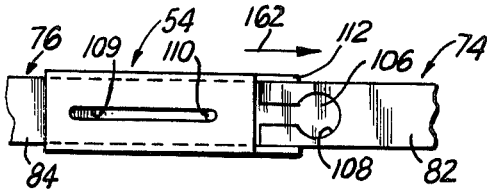
FIG. 5 is a fragmentary plan view showing the joined edges of the axle sections prior to locking.
Figure 6:
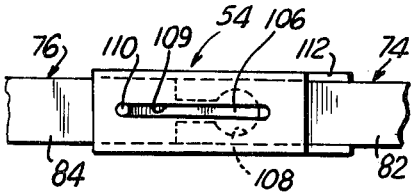
FIG. 6 is a view similar to that in FIG. 5, showing the joined edges in the locked position.

As can best be seen in FIG. 5, with the two arms in coaxial relationship, the key 106 will fit within the keyway 108. Slide 54 can then be moved to the right from its position on the connecting bar 84, as shown in FIG. 5 by the arrow 162, until it extends laterally across the keyway connection, as shown in FIG. 6. It should be appreciated that the tab or lip 112 provides an aligning seat for receiving the junction of the key and keyway, and holds these parts in place as the slide moves and locks the junction in position.

As can best be seen in FIG. 7, with the axle sections 74, 76 positioned in coaxial relationship in their extended position, they retain the support arms 34, 36 in their extended diverging positions. Accordingly, the locking sleeve 54 which slides across the medial ends of the axle sections 74, 76 to lock them into position, simultaneously serves to lock the support arms 34, 36 in their diverging extended position. Accordingly, the single locking mechanism or sleeve 54 provides a secure locking arrangement of the entire retractable assembly in its extended position and prevents the possibility of having any portion of the rolling assembly accidentally collapse during the rolling about of the golf bag.

When it is desired to retract or collapse the rolling assembly, the reverse procedure is followed. Specifically, the slide 54 is moved to the left onto the connecting bar 84, thereby exposing the key and keyway. The axle sections 74, 76 are folded against their respective arms 34, 36 and the arms 34, 36 are then pivoted inwardly to be received within the well 24. The spring clip 8 is then pulled upwardly and twisted into its transverse position to hold the parts securely in place in the well 24.

In the extended position, detachable wheels 164, 166 can respectively be placed on the shafts 90, 92, as shown in FIG. 7. These wheels can be stored in various locations in the golf bag when not in use. For example, they can be stored in the side, circular zipper compartment 168, or they can be stored in the elongated compartment 170 on the other side of the peripheral bag, or they can be placed and stored directly inside the golf bag itself.

The detachable wheels are securely retained in place by means of a floating ring or sleeve arrangement which can be best understood with respect to FIGS. 9-13. As shown, the shaft 90 which includes the collar 94 has a reduced diameter section 172 adjacent the distal end thereof. This reduced diameter section defines a central rod 174. This section 172 effectively divides up the shaft into a major portion 176 on which the wheel is placed, and an end portion 178.

Positioned within the reduced diameter section 172 is the annular ring or sleeve 98. Annular ring 98 has a wall thickness which is less than the undercut depth at the reduced diameter section 172. The outer diameter of the annular ring 98 is substantially equal to the outside diameter of the shaft 90, and the inner diameter of the ring 98 is greater than the diameter of the central rod 174. As a result, in the normal state, gravity acting on the annular ring 98 will pull it downward into the undercut, defining an interference position, whereby the lower edge of the ring 98 extends radially beneath the periphery of the shaft 90. At the same time, the annular ring 98 can be moved upwardly into a clearance position, so as to align its outer diameter with that of the shaft 90 whereby the entire exterior of the annular ring 98 is maintained within the peripheral dimension of the shaft 90.

Figure 11:
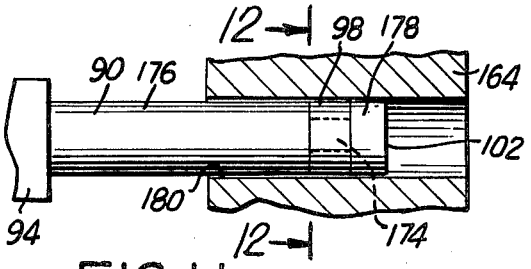
FIG. 11 is a view similar to that shown in FIG. 9, showing the positioning of a wheel onto the shaft.
Figure 12:
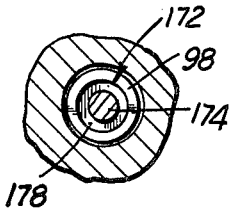
FIG. 12 is a sectional view taken along line 12—12 of FIG. 11.
Figure 13:
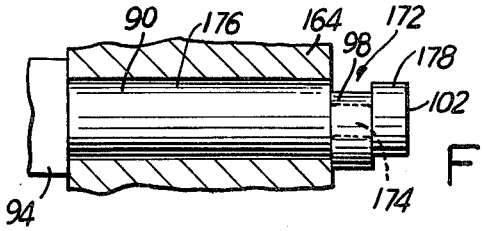
FIG. 13 is a fragmentary cross sectional view similar to that shown in FIGS. 9 and 11, showing the wheel positioned in place on the shaft and retained by means of the floating ring.

In order to position one of the wheels, such as the wheel 164 on the shaft 90, the annular ring 98 is moved to its clearance position where it is maintained aligned with the shaft. As shown in FIGS. 11 and 12, the wheel 164 can then be slid along the shaft 90 until it reaches the collar 94. When the wheel 164 is completely slid onto the shaft section 176, as shown in FIG. 13, the ring 98 is released so that gravity will pull it downward onto the rod 174 in the reduced diameter section 172, whereby it is positioned beneath the periphery of the shaft 90 and accordingly lies against the wheel 164 providing a stop to prevent removal of the wheel 164 from the shaft 90.

The distance that the ring 98 is axially spaced from the edge of the wheel provides the desired clearance needed for permitting wheel play during rotation. Also, the bore of the wheel typically approximates the outside diameter of the shaft to prevent excess wobbling of the wheel.

It should be noted, that the reduced diameter section 172 is formed adjacent the distal end of the shaft 90. With this type arrangement, as the wheel 164 is placed onto the distal end 178 of the shaft, if it is slightly angled with respect to the shaft, a lower edge 180 of the wheel bore can extend over the end 178 to reach the ring 98 and thus be used to align the ring 98 with the rest of the shaft. The wheel 164 can then be pivoted so that its bore is coaxial with the shaft and the wheel is then slid onto the shaft. Thus, with the ring 98 adjacent the distal end, the wheel itself can be used to move the ring into a clearance position and no extra manual manipulation of the ring is necessary.

The reduced diameter section 172 can be formed in various ways. For example, a single solid shaft can have a portion thereof machined by a given undercut depth to form the reduced diameter section. Alternately, the shaft can be formed with a central rod, an external sleeve covering the major portion of the rod, and an additional sleeve section covering the distal end of the rod leaving an intermediate portion of the central rod exposed therebetween to provide the reduced diameter section. Alternately, the shaft can have a hole machined in the end thereof and an external plug or screw can be fitted into the hole, where the shaft of the plug or screw forms the reduced diameter section, and the head of the plug or screw, having a common diameter with the shaft, forms the distal end part of the shaft. Other arrangements could similarly be utilized so long as a reduced diameter section is formed along the shaft portion to receive the ring.

The ring or sleeve 98 itself can also be of varied shapes and sizes. Although it is shown as being annular, it can have other arrangements, including a triangular configuration, an elongated oval or rectangular configuration, as well as other shapes. The requirements of such ring or sleeve would include that it has a wall thickness at one section which is less than the undercut depth measured from the outside diameter of the ring or sleeve to the reduced diameter section. This will permit the ring or sleeve, regardless of the shape, to be displaced into an interference position by means of gravity. Additionally, the outside largest dimension of the ring or sleeve, regardless of its shape, should be no greater than the diameter of the shaft. This will insure that in a clearance position, the periphery of the ring or sleeve will be retained within the peripheral dimension of the shaft and will not interfere with the placement of the wheel onto the shaft.

Figure 10:
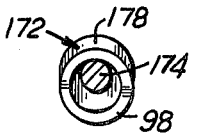
FIG. 10 is a sectional view taken along lines 10—10 of FIG. 9.

An additional requirement is that the distance from the inner surface of one section of the ring or sleeve to the outer surface of an opposing section of the ring or sleeve, must be greater than the reduced diameter section of the shaft plus the undercut depth, as best shown in FIG. 10. This will insure that when the ring or sleeve has its one section pulled downward by gravity onto the reduced diameter section, the opposing section of the ring or sleeve will extend beyond the periphery of the shaft at some point, so as to provide a blockage or stop to prevent the sliding off of the wheel from the shaft, as shown in FIG. 13.

It should also be appreciated that although the particular wheel locking arrangement shown in FIGS. 8–13 is in connection with the placement of the wheel onto the shaft extending from the golf cart axle, this same arrangement could be used in connection with any other shaft or axle wherever it is desired to have a detachable wheel.

Figure 14:
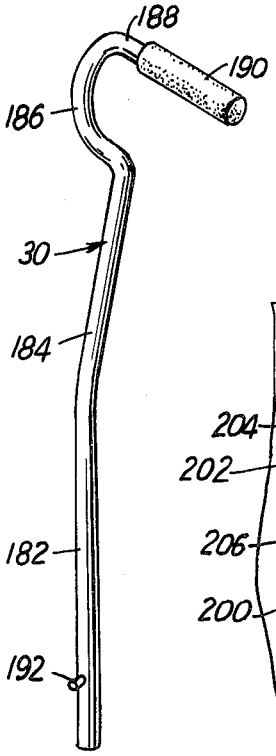
FIG. 14 is a perspective view of the handle used for pulling the cart about.

In order to facilitate rolling about of the golf bag, the handle 30 is provided. As best seen in FIG. 14, the handle 30 includes an elongated rod section which has a substantially straight lower portion 182 and an upper portion 184 slightly bent at an angle to facilitate manipulation of the handle. At the upper end of the rod section, there is provided a U-shaped extension 186 lying perpendicular to the rod portions 182, 184. The distal leg 188 of the U-shaped extension 186 continues laterally and supports a grasping portion 190 thereon. At the lower end of the rod portion 182, there extends a transverse pin 192 for securing the handle to the golf bag, as will hereinafter be explained.

Figure 15:
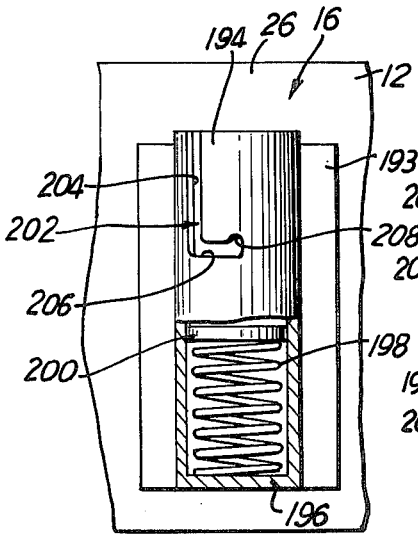
FIG. 15 is a fragmentary elevational view, partly broken away, showing the sleeve for receiving the handle.

Within the golf bag, on the interior wall thereof, specifically on an inside surface of the peripheral wall 26 which is the same wall that supports the rolling assembly 22 and the well 24 therefor on the exterior surface thereof, there is secured a support plate 193 on which is mounted a receiving sleeve 194. The plate 193 and sleeve 194 are positioned above the well 24 as shown in FIG. 7. The sleeve 194 is substantially circular in cross section having a closed bottom 196 and an open top. A compression spring 198 is placed between the bottom wall 196 and a movable disc or washer 200, as shown in FIG. 15. An L-shaped bayonet slot 202 extends downwardly from the upper edge of the sleeve 194 to a location above the upper extended position of the disc 200. Preferably, one end of the spring 198 is secured to the disc 200, and the opposite end of the spring is secured to the bottom wall 196 in a conventional manner.

Figure 16:
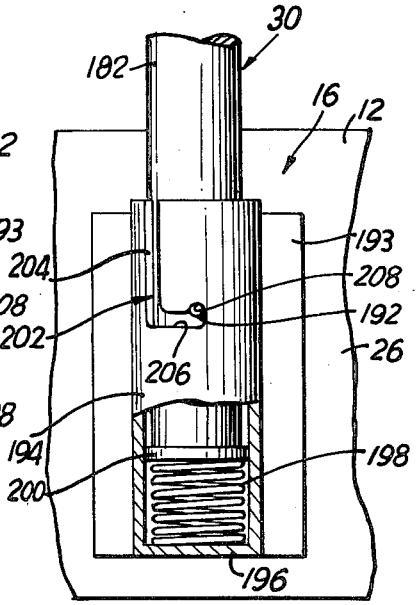
FIG. 16 is a view similar to that shown in FIG. 15 with the handle positioned and locked in the sleeve.

As best seen in FIG. 16, the handle 30 can be inserted into the sleeve with the pin 192 riding downwardly in the vertical portion 204 of the L-shaped slot 202 while pushing the disc 200 downwardly against the action of the spring 198. Then, by twisting the handle 30, the pin 192 rides in the horizontal leg 206 of the L-shaped slot. The lower end of the rod portion 182 continues to press against the pushed-down disc 200 so that the compression spring 198 will bias the handle upwardly when the handle is released and lock the pin 192 into the notch 208 formed at the end of the bayonet slot 202, thus securing the handle 30 to the golf bag.

In order to remove the handle, it is pressed downward so as to apply a force against the compression spring 198 whereby the pin 192 can be released from the notch 208. The handle can then be twisted and extracted from the sleeve 194. Once removed, the handle can be stored anywhere in the golf bag, specifically within either the golf bag itself or within the various compartments heretofore mentioned.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A gold bag comprising:

a container;

a retractible rolling assembly coupled to said container, said rolling assembly including a pair of support arms pivotally coupled to said container and extendable to an angular orientation with respect to said container, and an axle section pivotally coupled to a distal end of each support arm, said axle sections being extendable inwardly toward each other so as to lie in a coaxial relationship with each other, said support arms being substantially parallel in a retracted folded position and diverging from each other in an extended position;

pivot means for moving said rolling assembly between the extended position and the retracted folded position, said pivot means including an elbow joint coupling each of said axle sections to the distal end of its respective support arm to permit inward folding of each axle section adjacent and parallel to its respective support arm;

a shaft laterally extending from each axle section for supporting a detachable wheel;

locking means for securely retaining said rolling assembly in each of said extended and folded positions, and said locking means including coupling means for releasably locking together joined ends of said axle sections in their extended position, said coupling means simultaneously operating to lock said support arms in their extended position; and said support arms including U-shaped channels, distal ends of said channels being downwardly oriented, and a distal edge of each said channel abutting against its respective axle section to provide a limiting stop to prevent the unfolding of the axle section with respect to its respective support arm.

2. A golf bag as in claim 1, wherein said container includes a peripheral wall, and a recessed well provided in said peripheral wall for housing said rolling assembly in its folded position.

3. A golf bag as in claim 1, wherein each support arm in said folded position lies in a respective plane angularly oriented with respect to a longitudinal plane through said container and diverge from each other, said pivot means pivotally swings each support arm outwardly from said container along its respective plane.

4. A golf bag as in claim 1, wherein said elbow joint includes a U-shaped portion receiving channel provided at the distal end of each support arm, a bushing coupled to an exterior surface of the distal end of each axle section, said bushing being received within a corresponding receiving channel portion, and a pivot pin extending through said bushing and pivotally locking said bushing within said receiving channel portion.

5. A golf bag as in claim 1, wherein said locking means includes a locking mechanism for securely locking the entire rolling assembly in its folded position.

6. A golf bag as in claim 5, wherein said locking mechanism includes a spring biased locking clip coupled to said container, said locking clip being rotatable between a clamping position for retaining said rolling assembly in its folded position and a releasing position whereby said rolling assembly can be extended outwardly from said container.

7. A golf bag as in claim 1, and further comprising a removable handle mounted onto said container for pulling said container.

8. A golf bag as in claim 7, wherein said container includes a mouth and a sleeve mounted internally of said container adjacent to said mouth, a spring biased disc in said sleeve, an L-shaped bayonet slot provided in a wall of said sleeve above said disc, and a pin extending from a lower portion of said handle for locking into said bayonet slot when said handle extends through said mouth and is received in said sleeve, said handle being held biased against said disc within said sleeve.

9. A golf bag as in claim 1, wherein said container includes a storage compartment for storing said detachable wheel when detached.

10. A golf bag as in claim 1, wherein each said shaft includes a reduced diameter section provided adjacent a free end, sleeve means floating on each of said reduced diameter sections, each sleeve means being displaceable between an interference position wherein at least a portion of each said sleeve means extends radially beyond a peripheral dimension of its shaft to thereby retain the detachable wheel on said respective shaft, and a clearance position whereby each said sleeve means is entirely radially contained within the peripheral dimension of its shaft to thereby permit the detachable wheel to be mounted on and removed from said respective shaft.

11. A golf bag as in claim 10, wherein each said sleeve means is an annular ring having an outside diameter substantially equal to the outside diameter of its shaft, and a wall thickness less than the depth of said reduced diameter section from the outside surface of said respective shaft.

12. A golf bag comprising:

a container;

a retractable rolling assembly coupled to said container, said rolling assembly including a pair of support arms pivotally coupled to said container and extendable to an angular orientation with respect to said container, an axle section pivotally coupled to a distal end of each support arm, said axle sections being extendable inwardly toward each other so as to lie in a coaxial relationship with each other;

pivot means for moving said rolling assembly between an extended position and a retracted folded position; and locking means for securely retaining said rolling assembly in each of said extended and folded positions, said locking means including coupling means for releasably locking together joined ends of said axle sections in their extended position, said coupling means including a keyhole provided at a joining end of one axle section, a mating key provided at a joining end of the other axle section, and a sleeve slidable over the interconnected joined ends of said axle sections to securely retain said key positioned in said keyway.

13. A golf bag as in claim 12, and further comprising a pin extending from one axle section, a slot provided in said sleeve for receiving said pin, whereby said sleeve is slidably captured onto said one axle section and can slide onto the other axle section.

14. A golf bag as in claim 12, wherein said axle sections define an axle, a reduced diameter section provided adjacent opposite distal ends of said axle, sleeve means floating on each of said reduced diameter sections, each sleeve means being displaceable between an interference position wherein at least a portion of said sleeve means extends radially beyond a peripheral dimension of said axle to thereby retain a wheel on said axle, and a clearance position whereby said sleeve means is entirely radially contained within the peripheral dimension of said axle to thereby permit the wheel to be mounted on and removed from said axle.

15. A golf bag as in claim 14, wherein each said sleeve means is an annular ring having an outside diameter substantially equal to the outside diameter of the axle, and a wall thickness less than the depth of said reduced diameter section from the outside surface of said axle.

16. A golf bag as in claim 12, wherein said container includes a peripheral wall, and a recessed well provided in said peripheral wall for housing said rolling assembly in its folded position.

17. A golf bag as in claim 12, wherein said locking means includes a locking mechanism for securely locking the entire rolling assembly in its folded position, said locking mechanism including a spring biased locking clip coupled to said container, said locking clip being rotatable between a clamping position for retaining said rolling assembly in its folded position and a releasing position whereby said rolling assembly can be extended outwardly from said container.

18. A golf bag as in claim 12, and further comprising a removable handle mounted onto said container for pulling said container, said container including a mouth and a sleeve member mounted internally of said container adjacent to said mouth, a spring biased disc in said sleeve member, an L-shaped bayonet slot provided in a wall of said sleeve member above said disc, and a pin extending from a lower portion of said handle for locking into said bayonet slot when said handle extends through said mouth and is received in said sleeve member, said handle being held biased against said disc within said sleeve member.

19. A gold bag as in claim 12, wherein said rolling assembly includes at least one detachable wheel, and said container includes a storage compartment for storing said wheel when detached.

* * * * *